US010720716B2

(12) United States Patent
Clemente

(10) Patent No.: US 10,720,716 B2
(45) Date of Patent: Jul. 21, 2020

(54) WIDEBAND TRANSMITARRAY ANTENNA

(71) Applicant: Commissariat à l'Energie Atomique et aux Energies Alternatives, Paris (FR)

(72) Inventor: Antonio Clemente, Grenoble (FR)

(73) Assignee: COMMISSARIAT À L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 23 days.

(21) Appl. No.: 16/351,414

(22) Filed: Mar. 12, 2019

(65) Prior Publication Data

US 2019/0288403 A1 Sep. 19, 2019

(30) Foreign Application Priority Data

Mar. 14, 2018 (FR) ..... 18 52200

(51) Int. Cl.

| | |
|---|---|
| ***H01Q 21/00*** | (2006.01) |
| ***H01Q 21/22*** | (2006.01) |
| ***H01Q 21/06*** | (2006.01) |
| ***H01Q 3/46*** | (2006.01) |

(52) U.S. Cl.

CPC ..... *H01Q 21/22* (2013.01); *H01Q 3/46* (2013.01); *H01Q 21/061* (2013.01); *H01Q 21/065* (2013.01)

(58) Field of Classification Search

None

See application file for complete search history.

(56) References Cited

U.S. PATENT DOCUMENTS

2005/0264450 A1* 12/2005 Nishiyama ..... H01Q 21/065 343/700 MS
2011/0248897 A1* 10/2011 Alexopoulos ..... H01Q 15/006 343/711
2018/0040955 A1* 2/2018 Vouvakis ..... H01Q 5/42

OTHER PUBLICATIONS

Preliminary Search Report for French Application No. 1852200 dated Nov. 28, 2018, 2 pages.

S. Latif et al., "Study of the microtrip patch or ring as a cell element for a transmit-array with slotted ground plane,"2010 IEEE Antennas and Propogation Society Intl. Symposium (APURSI), Jul. 11, 2010, 4 pages.

(Continued)

*Primary Examiner* — Anh Q Tran

(74) *Attorney, Agent, or Firm* — Moreno IP Law LLC

(57) ABSTRACT

The invention concerns a transmit array (203) including a plurality of cells, each cell being capable of transmitting a radio signal by introducing into this signal a phase shift, said plurality of cells including cells of a first type (205-I) and cells of a second type (205-II), wherein: the array comprises a stack of first (M1), second (M2), and third (M3) conductive layers separated two by two by dielectric layers (D1, D2); each cell includes a first antenna element (205*a*) formed in the first conductive layer (M1) and a second antenna element (205*b*) formed in the third conductive layer (M3); in each cell of the first type, the first antenna element is connected to the second antenna element by a via (211) crossing the second conductive layer; and in each cell of the second type, the first antenna element is not connected to the second antenna element.

14 Claims, 3 Drawing Sheets

(56) References Cited

OTHER PUBLICATIONS

J. Lau et al., "Design and configuration of a 6×6 planar reconfigurable transmitarray," 2010 Proceedings of the 4th European Conf. on Antennas and Propogation (EUCAP), Apr. 12, 2010, 5 pages.
H Kaouach et al., "X-band transmit-arrays with linear and circular polarization," 2010 Proceedings of the 4th European Conf. on Antennas and Propogation 2010, Apr. 12, 2010, 5 pages.
A. Clemente et al., "Desing of a reconfigurable transit-array at X-band frequencies," 2010 15th Intl. Symposium on Antenna Technology and Applied Electromagnetics (ANTEM), Jun. 25, 2012, 4 pages.
C. Jouanlanne et al., "Wideband Linearly Polarized Transmitarray Antenna for 60 GHz Backhauling," IEEE Transactions on Antennas and Propogation, vol. 65, No. 3, Mar. 2017, pp. 1440-1445.
L. Dussopt et al., "A V-Band Switched-Beam Linearly Polarized Transmit-Array Antenna for Wireless Backhaul Applications," IEEE Transactions on Antennas and Propogation, vol. 65, No. 12, Dec. 2017, pp. 6788-6793.
A. Abbaspour-Tamijani et al., "A millimetre-wave bandpass filter—lens array," IET Microw. Antennas Propag., vol. 1, No. 2, Apr. 2007, pp. 388-395.
A. Abdelrahman et al., "Transmission Phase Limit of Multilayer Frequency-Selective Surfaces for Transmitarray Designs," IEEE Transactions on Antennas and Propogation, vol. 62, No. 2, Feb. 2014, pp. 690-697.

* cited by examiner

WIDEBAND TRANSMITARRAY ANTENNA

CROSS-REFERENCE TO RELATED APPLICATION

This application claims the priority benefit of French patent application number 18/52200, the content of which is hereby incorporated by reference in its entirety to the maximum extent allowable by law.

FIELD

The present application relates to the field of radio transmitarray antennas. It more particularly aims at a wideband transmit array, for example for applications between 1 and 300 GHz.

BACKGROUND

FIG. 1 is a simplified side view of a transmitarray antenna. Such an antenna typically comprises one or a plurality of primary sources 101 (a single source in the shown example) irradiating a transmit array 103. Array 103 comprises a plurality of elementary cells 105, for example, arranged in a matrix of rows and columns. Each cell 105 typically comprises a first antenna element 105*a* arranged on the side of a first surface of the array directed towards primary source 101, and a second antenna element 105*b* arranged on the side of a surface of the array opposite to the first surface. Each cell 105 is capable, in transmit mode, of receiving an electromagnetic radiation on its first antenna element 105*a* and of retransmitting this radiation from its second antenna element 105*b* with a known phase shift $\phi$, and, in receive mode, of receiving an electromagnetic radiation on its second antenna element 105*b* and of retransmitting this radiation from its first antenna element 105*a* with the same phase shift $\phi$.

The characteristics of the beam generated by the antenna, and particularly its shape (or profile) and its central direction (or pointing direction), depend on the values of the phase shifts introduced by the different cells.

Transmitarray antennas particularly have the advantages of having a good power efficiency, and of being relatively simple, inexpensive, and low-bulk, particularly due to the fact that the transmit arrays can be formed in planar technology, generally on a printed circuit.

The article entitled "Wideband linearly-polarized transmitarray antenna for 60 GHz backhauling" of C. Jouanlanne et al. (IEEE Transaction on Antennas and Propagation, vol. 65, no. 3, pp. 1440-1445, March 2017) describes an embodiment of a transmitarray antenna. In this example, the transmit array is a planar structure comprising a stack of first, second, and third conductive layers separated two by two by dielectric layers. Each elementary cell comprises a first conductive pattern formed in the first conductive layer and defining the first antenna element of the cell, and a second conductive pattern formed in the third conductive layer and defining the second antenna element of the cell. The second conductive layer forms a ground plane arranged between the first and second antenna elements. The coupling between the first and second antenna elements is achieved by means of an insulated conductive via crossing the ground plane and connecting the first antenna element to the second antenna element. The value of the phase shift introduced by each cell depends on the geometry of the cell and particularly on the shape, on the dimensions, and on the arrangement of the antenna elements and of the coupling via of the cell.

The article entitled "A V-band switched beam linearly-polarized transmitarray antenna for wireless backhaul applications" of L. Dussopt et al. (IEEE Transaction on Antennas and Propagation, vol. 65, no. 12, pp. 6788-6793, December 2017) describes another embodiment of a transmitarray antenna. In this example, the transmit array is also a planar structure comprising a stack of first, second, and third conductive layers separated two by two by dielectric layers. Each elementary cell comprises a first conductive pattern formed in the first conductive layer and defining the first antenna element of the cell, and a second conductive pattern formed in the third conductive layer and defining the second antenna element of the cell. The second conductive layer forms a ground plane arranged between the first and second antenna elements. In this embodiment, the first and second antenna elements are not connected, the coupling between the first and second elements being performed by means of a slot formed in the ground plane opposite the two elements. The value of the phase shift introduced by each cell depends on the geometry of the cell and particularly on the shape, on the dimensions, and on the arrangement of the antenna elements and of the coupling slot of the cell.

Conventionally, to limit the complexity and maximize the bandwidth of a transmit array, the elementary cells of the array may have a limited number N of configurations (shapes, dimensions and layout of the antenna and coupling elements), corresponding to N different phase shift values. In other words, on design of the array, each elementary cell is selected from among one of the N different configurations, respectively corresponding to N different phase shift values, which amounts to quantizing over $\log_2(N)$ bits the phase shift introduced by the cells. For example, in C. Jouanlanne et al.'s above-mentioned article, the elementary cells may have N=8 different configurations, which corresponds to a quantization over 3 bits of the phase shift introduced by the cells and, in L. Dussopt et al.'s above-mentioned article, the elementary cells may have N=7 different configurations, which corresponds to a quantization over 2.8 bits of the phase shift introduced by the cells.

In C. Jouanlanne et al.'s above-mentioned article, the transmit array is optimized to operate at a central frequency of 61.5 GHz and has a bandwidth at −1 dB in the range from 57 to 66 GHz, that is, a relative bandwidth at −1 dB of 15.4%.

In L. Dussopt et al.'s above-mentioned article, the transmit array is optimized to operate at a central frequency of 64.3 GHz and has a bandwidth at −3 dB in the range from 58.95 to 68.8 GHz, that is, a relative bandwidth at −3 dB of 15.4%.

It would be desirable to at least partly improve certain aspects of known transmitarray antennas.

In particular, it would be desirable to have a transmit array capable of operating at higher frequencies than known transmit arrays, and/or having a wider relative bandwidth than known transmit arrays, while limiting the number of metal layers used and taking into account the manufacturing limits of the selected technologies.

SUMMARY

Thus, an embodiment provides a transmit array comprising a plurality of cells, each cell being capable of transmitting a radio signal by introducing into this signal a phase shift, said plurality of cells comprising cells of a first type and cells of a second type, wherein:

the array comprises a stack of first, second, and third conductive layers separated two by two by dielectric layers;

each cell comprises a first antenna element formed in the first conductive layer and a second antenna element formed in the third conductive layer;

in each cell of the first type, the first antenna element is connected to the second antenna element by a via crossing the second conductive layer; and in each cell of the second type, the first antenna element is not connected to the second antenna element.

As previously indicated, the term "connected" means that, in cells of the first type, the conductive via is mechanically and electrically in contact with the first and second antenna elements, and the term "not connected" means that, in cells of the second type, no electric conductor directly connects the first and second antenna elements, that is, no electric conductor is mechanically and electrically in contact both with the first antenna element and with the second antenna element.

According to an embodiment, in each cell, the second antenna element at least partially faces the first antenna element.

According to an embodiment, in each cell of the second type, the first antenna element is coupled to the second antenna element by a slot formed in the second conductive layer, at least partially facing the first and second antenna elements.

The slot formed in the second conductive layer enables to transfer an electromagnetic wave between the first and second antenna elements.

According to an embodiment, the array comprises N different cell configurations, where N is an integer greater than or equal to 2, the array comprising a plurality of cells of each configuration.

According to an embodiment, the N cell configurations are selected so that the N phase shift values respectively introduced by the cells of the N configurations are in the order of 0°, 360°/N, 2*360°/N, . . . *360°/N.

According to an embodiment, N is equal to 8.

According to an embodiment, in each cell, the first antenna element is formed by a continuous conductive pattern and the second antenna element is formed by a continuous conductive pattern.

According to an embodiment, in each cell, the first antenna element occupies a surface area greater than 20% of the surface area of the cell, and the second antenna element occupies a surface area greater than 20% of the surface area of the cell.

According to an embodiment, in each type-I cell, the via runs through an opening formed in the second conductive layer opposite the first and second antenna elements.

According to an embodiment, in each type-I cell, the via and the opening are arranged so that the via is not in contact with the second conductive layer.

According to an embodiment, the first conductive layer is a discontinuous layer such that the first antenna elements of the different cells are insulated from one another and the third conductive layer is a discontinuous layer such that the second antenna elements of the different cells are insulated from one another.

According to an embodiment, the second conductive layer forms a ground plane common to all the cells of the array.

Another embodiment provides a transmitarray antenna comprising a transmit array such as defined hereabove, and at least one primary source configured to irradiate a surface of the array.

According to an embodiment, the antenna is capable of operating at a frequency in the range from 1 to 300 GHz.

The foregoing and other features and advantages will be discussed in detail in the following non-limiting description of specific embodiments in connection with the accompanying drawings.

DETAILED DESCRIPTION OF THE PRESENT EMBODIMENTS

Figure 1:
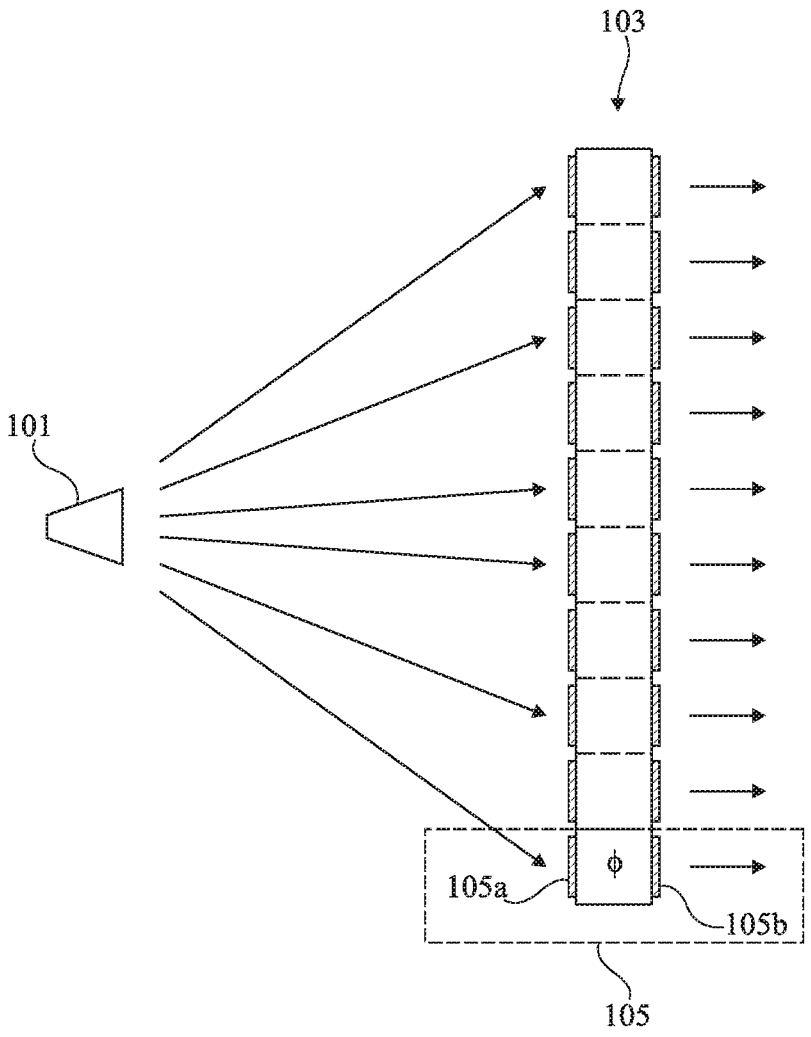
FIG. 1, previously described, is a simplified side view of a transmitarray antenna.

The same elements have been designated with the same reference numerals in the various drawings and, further, the various drawings are not to scale. For clarity, only those steps and elements which are useful to the understanding of the described embodiments have been shown and are detailed.

In particular, embodiments of a transmit array for a transmitarray antenna will be described hereafter. The structure and the operation of the primary source(s) of the antenna, intended to irradiate the transmit array, will however not be detailed, the described embodiments being compatible with all or most of known primary irradiation sources for a transmitarray antenna. As an example, each primary source is capable of generating a beam of generally conical shape irradiating all or part of the transmit array. Each primary source for example comprises a horn antenna. As an example, the central axis of each primary source is substantially orthogonal to the mean plane of the array.

Further, the methods of manufacturing the described transmit arrays will not be detailed, the forming of the described structures being within the abilities of those skilled in the art based on the indications of the present description, for example, by using usual printed circuit manufacturing techniques.

In the following description, when reference is made to terms qualifying absolute positions, such as terms "front", "rear", "top", "bottom", "left", "right", etc., or relative positions, such as terms "above", "under", "upper", "lower", etc., or to terms qualifying directions, such as terms "horizontal", "vertical", etc., it is referred to the orientation of the drawings, it being understood that, in practice, the described devices may be oriented differently. The terms "approximately", "substantially", and "in the order of" are used herein to designate a tolerance of plus or minus 10%, preferably of plus or minus 5%, or, regarding angular values, of plus or minus 10°, preferably of plus or minus 5°, of the value in question.

Figure 2:
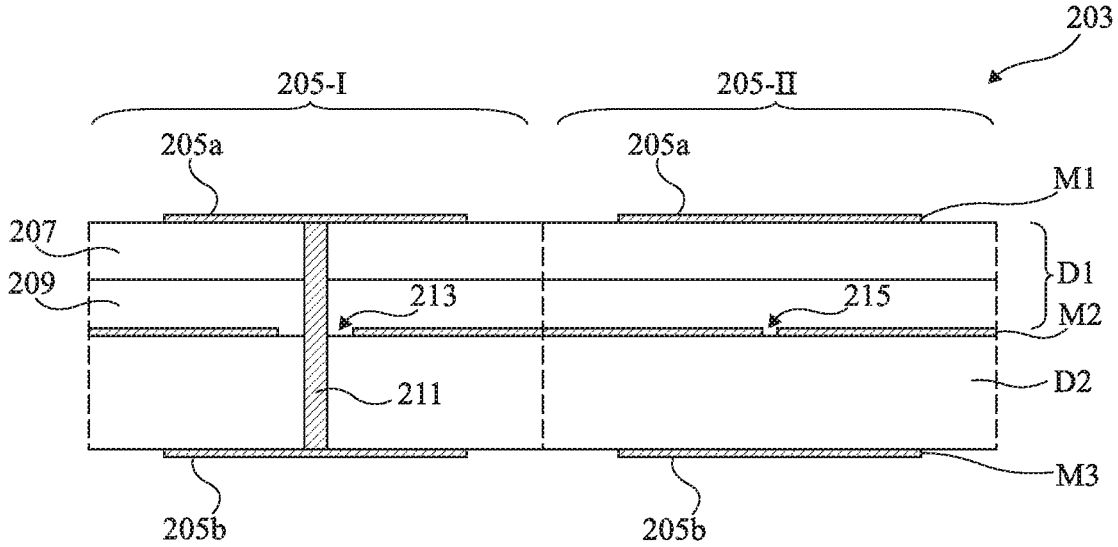
FIG. 2 is a partial simplified cross-section view of an example of a transmit array of a transmitarray antenna according to an embodiment.

FIG. 2 is a partial simplified cross-section view of an example of a transmit array 203 of a transmitarray antenna according to a first embodiment. Array 203 forms a radiating panel operating in transmit mode, that is, capable of receiving an electromagnetic radiation on a first surface of the panel and of retransmitting the radiation from a second surface of the panel opposite to the first surface, or of receiving an electromagnetic radiation on its second surface and of retransmitting the radiation from its first surface. Array 203 comprises a plurality of elementary cells 205, for example, arranged in an array of rows and of columns. In FIG. 2, only two elementary cells 205-I and 20541 have been shown. In practice, transmit array 203 may comprise a much higher number of elementary cells 205, for example, in the order of 1,000 elementary cells or more. The elementary cells 205 of transmit array 203 are for example contiguous. Elementary cells 205 for example all substantially have the same dimensions. As an example, in top view, elementary cells 205 have a square shape having a side length substantially equal to half the central operating wavelength of the antenna.

Each cell 205 comprises a first antenna element 205*a* arranged on the side of a first surface of array 203, for example, the surface of the array intended to be directed towards the primary source(s) (not shown in FIG. 2) of the antenna, and a second antenna element 205*b* arranged on a surface of array 203 opposite to the first surface.

Each cell 205 is capable, in transmit mode, of receiving an electromagnetic radiation on its first antenna element 205*a* and of retransmitting this radiation from its second antenna element 205*b* with a known phase shift $\phi$, and, in receive mode, of receiving an electromagnetic radiation on its second antenna element 205*b* and of retransmitting this radiation from its first antenna element 205*a* with the same phase shift $\phi$.

The characteristics of the beam generated by the antenna, and particularly its shape (or profile) and its central direction (or pointing direction), depend on the values of the phase shifts introduced by the different cells 205.

The transmit array 203 of FIG. 2 may be formed in planar technology, for example, on a printed circuit board, or on a substrate made of silicon, or quartz, etc. In a preferred embodiment, array 203 is formed on a printed circuit board, in PCB technology. This technology indeed has the advantage of having a low cost and of enabling to generate at a large scale arrays having a large surface area.

Array 203 of FIG. 2 comprises a stack of three conductive layers (or conductive levels) M1, M2, and M3, respectively called first, second, and third conductive layers M1, M2, and M3, separated two by two by dielectric layers D1 and D2. More particularly, in the example of FIG. 2, third conductive layer M3 forms the lower layer of the stack, dielectric layer D2, called second dielectric layer, is arranged on top of and in contact with the upper surface of the third conductive layer M3, second conductive layer M2 is arranged on top of and in contact with the upper surface of second dielectric layer D2, dielectric layer, called first dielectric layer, is arranged on top of and in contact with the upper surface of second conductive layer M2, and first conductive layer M1 is arranged on top of and in contact with the upper surface of first dielectric layer D1.

Conductive layers M1, M2, and M3 are for example metal layers, for example, made of copper. Each of conductive layers M1, M2, M3 for example has a thickness in the range from 1 to 30 μm, for example, in the order of 17 μm. Second dielectric layer D2 is for example formed of a laminated multilayer made up of polytetrafluoroethylene (PTFE) and of ceramic, for example, of the type commercialized by company Rogers under trade name Duroid®6002. As an example, second dielectric layer D2 has a thickness in the order of 254 μm. In the shown example, first dielectric layer D1 is formed of a stack of a dielectric layer 207 and of a film of dielectric glue 209. Glue film 209 is arranged on top of and in contact with the upper surface of second conductive layer M2, and layer 207 is arranged on top of and in contact with the upper surface of glue film 209 (conductive layer M1 being arranged on top of and in contact with the upper surface of layer 207). Dielectric layer 207 is for example formed of a laminated multilayer made up of polytetrafluoro-ethylene (PTFE) and of ceramic, for example, of the type commercialized by company Rogers under trade name Duroid®6002. As an example, layer 207 has a thickness in the order of 127 μm. Glue film 209 is for example an adhesive layer particularly having the function of bonding layer 207 to the upper surface of layer M2. Glue film 209 for example has a thickness in the order of 100 μm. As an example, layer M2 is printed on the upper surface of second dielectric layer D2 before the bonding of layer D1 to the upper surface of layer M2. Layers M3 and M1 may be respectively printed on the lower surface of layer D2 and on the upper surface of layer 207. In the example of FIG. 2, transmit array 203 comprises only three conductive layers M1, M2, and M3, that is, it comprises no additional conductive layer on the side of the upper surface of conductive layer M1, and it comprises no additional conductive layer on the side of the lower surface of conductive layer M3. It should be noted that the above-mentioned thicknesses of the different layers are given as an illustration only. Such thicknesses have been optimized for an operation at a central frequency in the order of 141 GHz. Such thicknesses may however be modified according to the needs of the application, for example, to form an antenna intended to operate at higher or lower frequencies.

In the example of FIG. 2, the first antenna elements 205*a* of the elementary cells 205 are formed in the upper conductive layer M1 and the second antenna elements 205*b* of the elementary cells 205 are formed in the lower conductive layer M3.

In each elementary cell 205, upper antenna element 205*a* is formed by a conductive pattern formed in conductive layer M1. Pattern means that the shape taken by the conductive layer has given geometric specificities. The antenna element 205*a* of each elementary cell 205 is electrically insulated from the antenna elements 205*a* of the other cells of the array. In other words, conductive layer M1 is a discontinuous layer, that is, a peripheral strip of the conductive material of layer M1 is removed around each antenna element 205*a*, separating antenna element 205*a* from the neighboring cells. In each elementary cell 205, the conductive pattern forming antenna element 205*a* is for example a continuous or monoblock pattern. As an example, the conductive pattern forming antenna element 205*a* occupies, in top view, a surface area greater than 20% of the surface area of cell 205.

In each elementary cell 205, lower antenna element 205*b* is formed by a conductive pattern or conductive pad formed in conductive layer M3. Lower antenna element 205*b* is arranged at least partly opposite (vertically in line with) upper antenna element 205*a*. The antenna element 205*b* of each elementary cell 205 is electrically insulated from the antenna elements 205*b* of the other cells of the array. In other words, conductive layer M3 is a discontinuous layer. In each elementary cell 205, the conductive pattern forming antenna element 205*b* is for example a continuous pattern. As an example, the conductive pattern forming antenna element 205*b* occupies a surface area greater than 20% of the upper surface area of cell 205.

In the example of FIG. 2, intermediate conductive layer M2 forms a ground plane extending continuously over substantially the entire surface of array 203.

According to an aspect of an embodiment, the transmit array 203 of FIG. 2 comprises two types of elementary cells 205, so-called type-I cells (205-I) and so-called type-II cells (205-II).

Each type-I cell comprises a conductive via 211 crossing dielectric layers D1 and D2 and intermediate conductive layer M2, via 211 being arranged to connect the upper antenna element 205*a* to the lower antenna element 205*b*. Connect here means that via 211 is mechanically and electrically in contact, by its upper surface, with the lower surface of antenna element 205*a* and, by its lower surface, with the upper surface of antenna element 205*b*. Conductive via 211 is insulated, that is, it is not in electric contact with intermediate conductive layer M2. In other words, via 211 is arranged to cross intermediate conductive layer M2 without touching it, and is thus insulated from intermediate conductive layer M2. More particularly, in the shown example, in each elementary type-I cell, intermediate layer M2 comprises a local opening 213, for example, a circular opening, opposite the upper and lower antenna elements 205*a* and 205*b*. Via 211 extends vertically from the lower surface of antenna element 205*a* to the upper surface of antenna element 205*b* (through dielectric layers D1 and D2), through opening 213. Via 211 enables to transfer the energy between antenna elements 205*a* and 205*b*. The conductive via is for example made of metal, for example, of copper.

In type-II cells 205, no via 211 crossing dielectric layers D1 and D2 and conductive layer M2 is provided, and the upper antenna element 205*a* of the cell is not connected to the lower antenna element 205*b* of the cell. In other words, no electrically conductive element directly couples the antenna element 205*a* of the cell to the antenna element 205*b* of the cell. As an example, in each type-II cell 205, conductive layer M2 comprises a local opening 215. Opening 215 has a specific geometry, for example, an I- or H-shaped slot (in top view, not shown in FIG. 2), at least partly arranged opposite the antenna elements 205*a* and 205*b* of the cell. Opening 215 enables to transfer the energy between antenna elements 205*a* and 205*b*.

Thus, in the embodiment of FIG. 2, array 203 combines elementary cells where the coupling between antenna elements 205*a* and 205*b* is achieved by a via (type I) and elementary cells where the coupling between antenna elements 205*a* and 205*b* is performed with no via (type II). Cell types I and II have the common point that intermediate conductive layer M2 comprises an opening arranged either to give way to a conductive via insulated from layer M2 (in type-I cells) or to form a slot having a specific pattern, for example I- or H-shaped (in type-II cells).

Figure 3A:
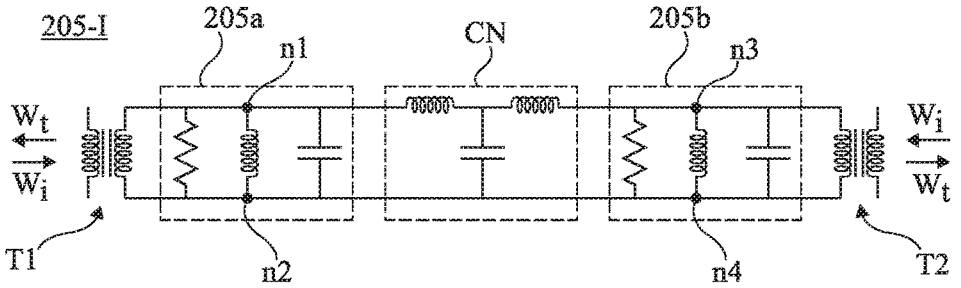
FIGS. 3A and 3B are equivalent electric diagrams modeling the behavior of two types of elementary cells of a transmit array of a transmitarray antenna according to an embodiment.
Figure 3B:
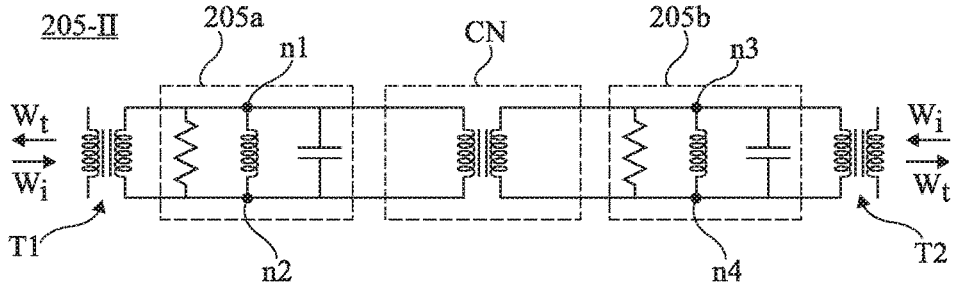

FIGS. 3A and 3B are equivalent electric diagrams respectively modeling the behavior of a type-I cell and of a type-II cell of the transmit array 203 of FIG. 2.

In both cell types, antenna element 205*a* is modeled by a parallel association of a resistor, of an inductance, and of a capacitor between nodes n1 and n2 of the circuit, and antenna element 205*b* is modeled by a parallel association of a resistor, of an inductance, and of a capacitor between nodes n3 and n4 of the equivalent circuit.

In both types of cells, the equivalent circuit further comprises a transformer T1 modeling the coupling between a primary source of the antenna and the antenna element 205*a* of the cell. Transformer T1 comprises two magnetically-coupled conductive windings, one of the two windings having its ends respectively connected to nodes n1 and n2 of the equivalent circuit, and the other winding having its two ends respectively connected to two nodes of an equivalent circuit (not shown) modeling the primary source. Transformer T1 models the transmission of an incident electromagnetic wave Wt from the primary source to antenna element 205*a*, or of an electromagnetic wave Wt transmitted by the cell, from antenna element 205*a* to the primary source.

In both types of cells, the equivalent circuit further comprises a transformer T2 modeling the coupling between an external source and the antenna element 205*b* of the cell. Transformer T2 comprises two magnetically coupled conductive windings, one of the two windings having its ends respectively connected to nodes n3 and n4 of the equivalent circuit, and the other winding having its two ends respectively connected to two nodes of an equivalent circuit (not shown) modeling the external source. Transformer T2 models the transmission of an incident electromagnetic wave Wt from the external source to antenna element 205*b*, or of an electromagnetic wave Wt transmitted by the cell, from antenna element 205*b* to the external source or in the propagation space.

Further, in both types of cells, the equivalent circuit comprises a coupling network CN having a first input/output node connected to node n1, a second input/output node connected to node n2, a third input/output node connected to node n3, and a fourth input/output node connected to node n4. Circuit CN models the coupling between antenna elements 205*a* and 205*b* of the cell.

In type-I cells (coupled with a via), there exists a direct electric connection between antenna elements 205*a* and 205*b*. Coupling network CN comprises a series association of two inductances coupling node n1 to node n3, and a capacitor having a first electrode connected to the junction point of the two inductances and a second electrode connected to nodes n2 and n4.

In type-II cells (coupling with no via), there exists no direct electric connection between antenna elements 205*a* and 205*b*. Coupling network CN comprises a transformer formed of two magnetically coupled windings, the first winding having its ends respectively connected to nodes n1 and n2 and the second winding having its ends respectively connected to nodes n3 and n4.

The tests carried out have shown that the fact of combining cells coupled by a via and cells coupled with no via in a same transmit array enables to reach higher operating frequencies and/or to obtain wider bandwidths than when a single type of cell is used. In particular, combining the two topologies enables to do away with the limits and manufacturing tolerances of a fixed manufacturing technology and thus to obtain wider bandwidths than when a single type of cell is used.

To limit the complexity and maximize the bandwidth of the transmit array, the elementary cells of the array may have a limited number N of configurations (shapes, dimensions, and arrangement of the antenna and coupling elements), corresponding to N different phase-shift values, where N is an integer greater than or equal to 2. In other words, on design of the array, each elementary cell is selected from among one of N different configurations, respectively corresponding to N different phase-shift values, which amounts to quantizing over log 2(N) bits the phase shift introduced by the cells. The cells of a same configuration are identical to within manufacturing dispersions, and the transmit array may comprise a plurality of cells of each configuration. As an example, N is an integer greater than or equal to 4 and, among the N cell configurations, a plurality are of type I (coupled by a via) and a plurality are of type II (coupled with no via). The N cell configurations are preferably selected so that the N phase shift values respectively introduced by the cells of the N configurations are in the order of 0°, 360°/N, 2*360°/N, . . . (N−1)*360°/N.

Figure 4:
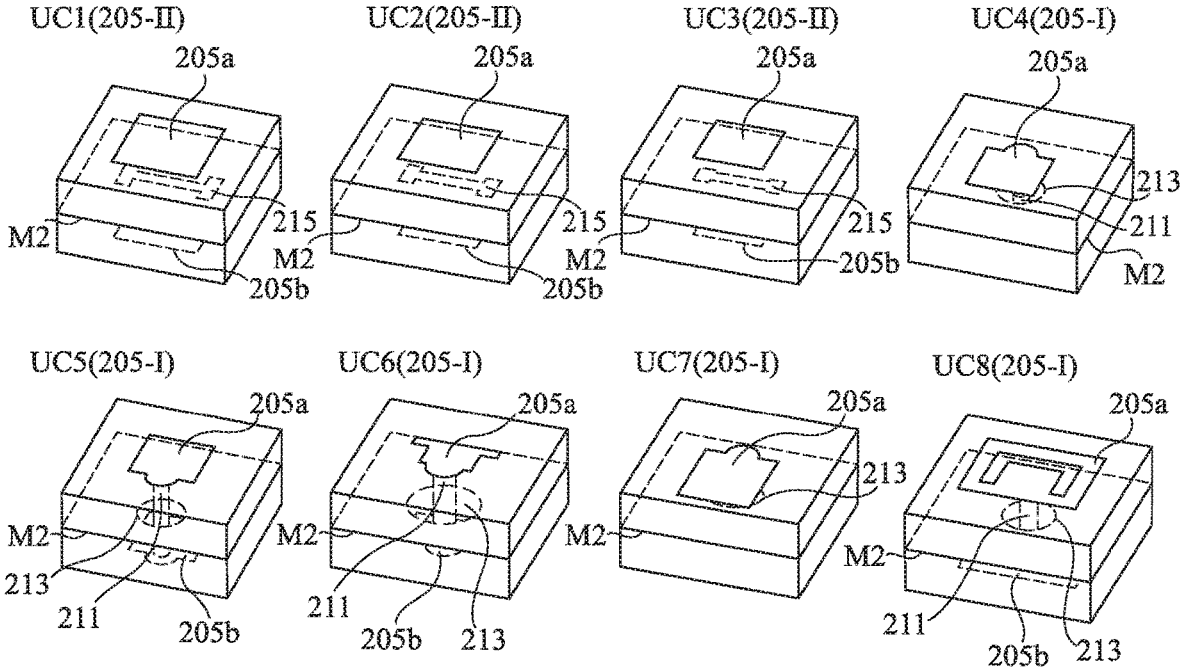
FIG. 4 is a perspective view illustrating different configurations which may be taken by the elementary cells of a transmit array of a transmitarray antenna according to an embodiment.

FIG. 4 is a perspective view illustrating in further detail an embodiment of elementary cells of the array. In this example, number N of different cell configurations is set to 8, which corresponds to a quantization over 3 bits of the phase shift value introduced by the cells, with relative phase shift values of the 8 cell configurations respectively in the order of 0°, 45°, 90°, 135°, 180°, 225°, 270°, and 315°. In this example, the cells have been optimized for an operation at a central frequency of 141 GHz. Call UC1, UC2, UC3, UC4, UC5, UC6, UC7, and UC8 the 8 cell configurations.

In this example, cells UC1, UC2, and UC3 are of type II (coupling with no via) and cells UC4, UC5, UC6, UC7, and UC8 are of type I (coupling with a via).

In each of type-II cells UC1, UC2, and UC3, the antenna elements 205*a* and 205*b* of the cell each have a pattern corresponding to a full plate of rectangular shape. Further, in each of cells UC1, UC2, and UC3, antenna element 205*a* has the same dimensions as antenna element 205*b* and is arranged to entirely face antenna element 205*b*. In other words, in each of cells UC1, UC2, and UC3, antenna element 205*a* has the same shape and the same dimensions as antenna element 205*b* and is placed to entirely face antenna element 205*b*. In each of cells UC1, UC2, and UC3, coupling slot 215 is I-shaped. Cells UC1, UC2, and UC3 differ from one another by the dimensions of their antenna elements 205*a* and 205*b* and/or of their coupling slot 215. This enables to adjust the response of each cell to obtain the necessary phase states.

In each of type-I cells UC4, UC5, UC6, and UC7, antenna elements 205*a* and 205*b* of the cell each have the shape of a full plate having rectilinear edges and at least one rounded or more generally curvilinear edge. Further, in each of cells UC4, UC5, UC6 and UC7, antenna element 205*a* has the same shape and the same dimensions as antenna element 205*b* and is placed at least partially opposite antenna element 205*b*. Cells UC4, UC5, UC6, and UC7 differ from one another by the shapes and/or dimensions of their antenna elements 205*a* and 205*b* and/or by the diameter of their circular opening 213 formed in conductive layer M2 or by the diameter of their conductive via 211.

In type-I cell UC8, antenna elements 205*a* and 205*b* each have the shape of a rectangular plate comprising a U-shaped opening in its central portion. Further, antenna element 205*a* has the same dimensions as antenna element 205*b*, and is placed to entirely face antenna element 205*b*.

More generally the type-I and II elementary cells may be formed from any other pattern which is easy to industrialize, it being understood that, to obtain the desired phase shifts, one or a plurality of the following parameters may be varied: the shape of antenna elements 205*a* and 205*b*, the dimensions of opening 213 and 215 formed in conductive layer M2, the dimensions of antenna elements 205*a* and/or 205*b*, the dimensions of conductive via 211 or of slot 215, etc.

Figure 5A:
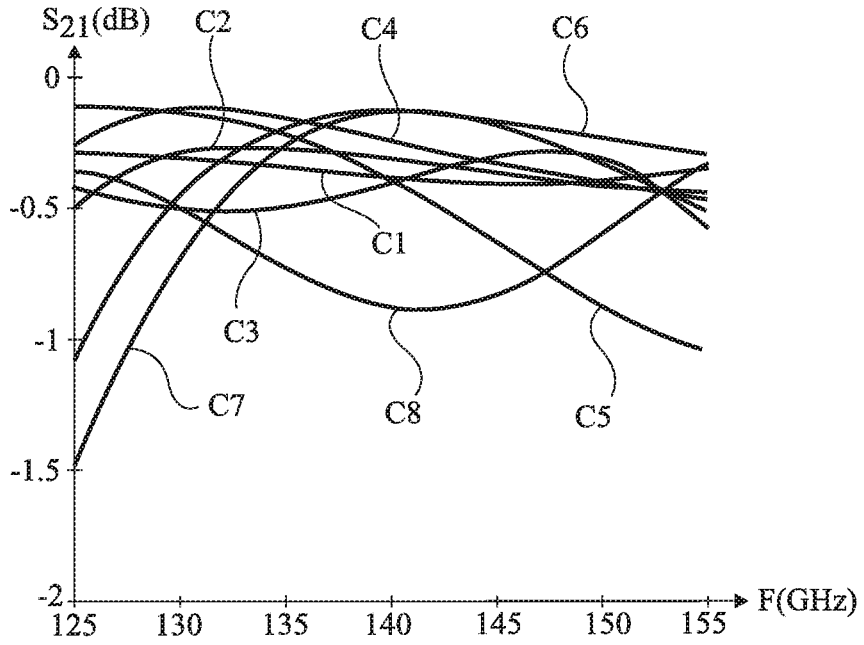
FIGS. 5A and 5B respectively illustrate the frequency variation of the amplitude and of the phase of the transmission coefficient of the different elementary cells of FIG. 4.
Figure 5B:
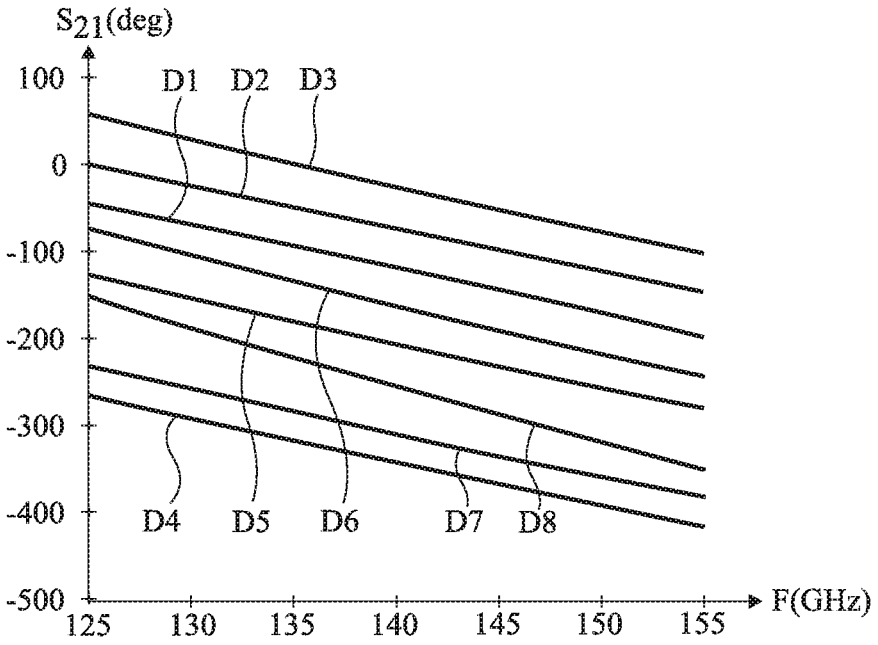

FIGS. 5A and 5B illustrate the frequency response of elementary cells UC1, UC2, UC3, UC4, UC5, UC6, UC7, and UC8 of the example of FIG. 4.

FIG. 5A illustrates the variation, according to frequency F of the incident wave (in abscissa, in GHz), of the amplitude of the transmission coefficient S21 (in ordinate, in dB) of each cell. FIG. 5A more particularly comprises eight curves C1, C2, C3, C4, C5, C6, C7, and C8 showing the variation of the amplitude of the transmission coefficient respectively for the eight configurations of elementary cells UC1, UC2, UC3, UC4, UC5, UC6, UC7, and UC8 of the example of FIG. 4.

FIG. 5B illustrates the variation, according to frequency F of the incident wave (in abscissa, in GHz), of the phase of the transmission coefficient S21 (in ordinate in degrees) of each cell. FIG. 5B more particularly comprises eight curves D1, D2, D3, D4, D5, D6, D7, and D8 showing the variation of the phase of the transmission coefficient respectively for the eight configurations of elementary cells UC1, UC2, UC3, UC4, UC5, UC6, UC7, and UC8 of the example of FIG. 4.

As shown in FIG. 5A, the bandwidth at −1 dB of the transmit array has a width in the order of 29 GHz, for a central operating frequency in the order of 141 GHz, that is, a relative bandwidth of approximately 20%.

FIG. 5B illustrates the respective phase shifts introduced by the different cells. Taking cell UC2 (curve D2) as a reference cell (zero phase shift), it can be seen in FIG. 5B that whatever the operating frequency (in the above-mentioned 29-GHz band centered on a central operating frequency of 141 GHz), cell UC3 (curve D3) introduces a relative phase shift (as compared with the phase shift introduced by cell UC2) of approximately 45°, cell UC4 introduces a relative phase shift of approximately 90°, cell UC7 introduces a relative phase shift of approximately 135°, cell UC8 introduces a relative phase shift of approximately 180°, cell UC5 introduces a relative phase shift of approximately 225°, cell UC6 introduces a relative phase shift of approximately 270°, and cell UC1 introduces a relative phase shift of approximately 315°.

Thus, the embodiment described in relation with FIG. 2, comprising combining within a same transmit array elementary cells coupled with a via and elementary cells coupled with no via, enables to reach particularly high operating frequencies, with relatively large bandwidths.

Although such a solution is particularly adapted to the forming of antennas intended to operate at frequencies in the range from 80 GHz to 200 GHz, it may more generally be used at other frequencies, for example, to form antennas intended to operate at frequencies in the range from 1 to 300 GHz.

Specific embodiments have been described. Various alterations, modifications, and improvements will occur to those skilled in the art. In particular, the described embodiments are not limited to the embodiments of type-I and II cells described in relation with FIGS. 2 and 4.

It should in particular be noted that type-II cells (coupled with no via) may comprise cells similar to what has been described in relation with FIG. 2, but comprising no slot in ground plane M2 opposite antenna elements 205*a* and 205*b*.

Further, the described embodiments are not limited to the examples of dimensions and of materials mentioned in the present application.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A transmit array comprising a plurality of cells, each cell being capable of transmitting a radio signal by introducing into this signal a phase shift, said plurality of cells comprising cells of a first type and cells of a second type, wherein:

the array comprises a stack of first, second, and third conductive layers separated two by two by dielectric layers;

each cell comprises a first antenna element formed in the first conductive layer and a second antenna element formed in the third conductive layer;

in each cell of the first type, the first antenna element connected to the second antenna element by a via crossing the second conductive layer; and in each cell of the second type, the first antenna element is not connected to the second antenna element.

2. The transmit array of claim 1, wherein, in each cell, the second antenna element at least partially faces the first antenna element.

3. The transmit array of claim 1, wherein, in each cell of the second type, the first antenna element is coupled to the second antenna element by a slot formed in the second conductive layer, at least partially facing the first and second antenna elements.

4. The transmit array of claim 1, comprising N different cell configuration, where N is an integer greater than or equal to 2, the array comprising a plurality of cells of each configuration.

5. The transmit array of claim 4, wherein the N cell configurations are selected so that the N phase shift values respectively introduced by the cells of the N configurations are in the order of 0°, 360°/N, 2*360°/N, . . . (N−1)*360°/N.

6. The transmit array of claim 5, wherein N is equal to 8.

7. The transmit array of claim 1, wherein, in each cell, the first antenna element is formed by a continuous conductive pattern and the second antenna element is formed by a continuous conductive pattern.

8. The transmit array of claim 1, wherein, in each cell, the first antenna element occupies a surface area greater than 20% of the surface area of the cell, and the second antenna element occupies a surface area greater than 20% of the surface area of the cell.

9. The transmit array of claim 1, wherein, in each type-I cell, the via runs through an opening formed in the second conductive layer.

10. The transmit array of claim 9, wherein, in each type-I cell, the via and the opening are arranged so that the via is not in contact with the second conductive layer.

11. The transmit array of claim 1, wherein the first conductive layer is a discontinuous layer such that the first antenna elements of the different cells are insulated from one another and the third conductive layer is a discontinuous layer such that the second antenna elements of the different cells are insulated from one another.

12. The transmit array of claim 1, wherein the second conductive layer forms a ground plane common to all the cells in the array.

13. A transmit array antenna comprising the transmit array claim 1, and at least one primary source configured to irradiate a surface of the array.

14. The antenna of claim 13, capable of operating at a frequency in the range from 1 to 300 GHz.

* * * * *